United States Patent [19]

Sines et al.

[11] Patent Number: 4,591,165

[45] Date of Patent: May 27, 1986

[54] RACKET HAVING STRINGS WHICH PASS OVER ROCKABLE TENSION TRANSMITTING MEANS

[75] Inventors: Randy D. Sines, Oxnard; Bruce W. Farber, Oak View, both of Calif.

[73] Assignee: Karakal Corp. of the Americas, Oxnard, Calif.

[21] Appl. No.: 670,402

[22] Filed: Nov. 14, 1984

[51] Int. Cl.[4] ..... A63B 49/00

[52] U.S. Cl. ..... 273/73 D

[58] Field of Search ..... 273/73 D, 73 C, 73 G, 273/73 H, 73 K, 73 L, 73 R, 67 R

[56] References Cited

U.S. PATENT DOCUMENTS

| | | | |
|---|---|---|---|
| 1,470,878 | 10/1923 | Robinson | 273/73 D |
| 1,523,865 | 1/1925 | Craig | 273/73 D |
| 1,559,986 | 1/1925 | Quick . | |
| 3,999,756 | 12/1976 | Head . | |
| 4,118,029 | 10/1978 | Septier | 273/73 D |
| 4,185,822 | 1/1980 | Li | 273/73 C |
| 4,203,597 | 5/1980 | Reedhead et al. . | |
| 4,441,712 | 4/1984 | Guthke . | |
| 4,462,592 | 7/1984 | Legger et al. . | |

FOREIGN PATENT DOCUMENTS

| | | | |
|---|---|---|---|
| 873589 | 3/1942 | France | 273/73 D |
| 4365 | of 1914 | United Kingdom | 273/73 D |
| 262638 | 12/1926 | United Kingdom | 273/73 D |
| 309238 | 4/1929 | United Kingdom | 273/73 D |

*Primary Examiner*—Richard C. Pinkham
*Assistant Examiner*—Matthew L. Schneider
*Attorney, Agent, or Firm*—Wells, St. John & Roberts

[57] ABSTRACT

The present invention makes use of tension transmitting device between an outward head frame surface and string chords such that tension along one string chord can be transmitted through the tension transmitting device to the next adjacent string chord. Transmission of tension allows strain energy to be stored in several string chords instead of only those directly contacted by the impacting object. This results in larger string deflection with a smaller increase in string tension. A first form of the tension transmitting device is an independent rocker member that can be received between the string as it wraps over the outer racket head surface between adjacent holes. The rockers receive the string along top rocker surfaces. Bottom rocker surfaces are substantially cylindrical for friction-free rocking engagement against the outer surface of the racket head frame. Tension applied along one of the string chord segments will therefore be directly transmitted through rocking motion of the rocker device to the adjacent string chords throughout the entire string length.

8 Claims, 6 Drawing Figures

FIG 4
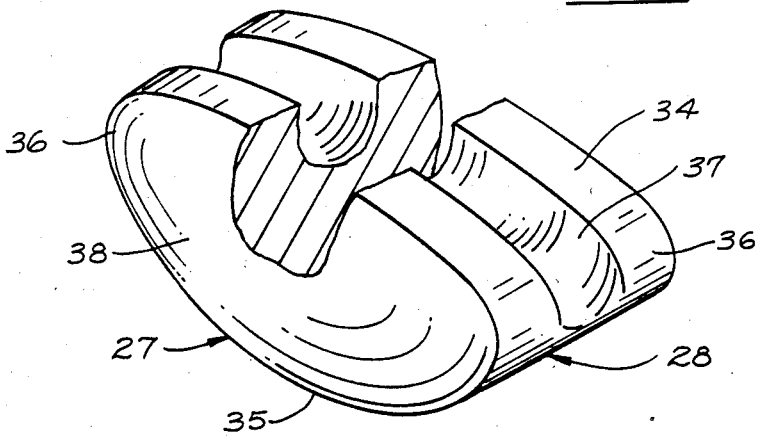
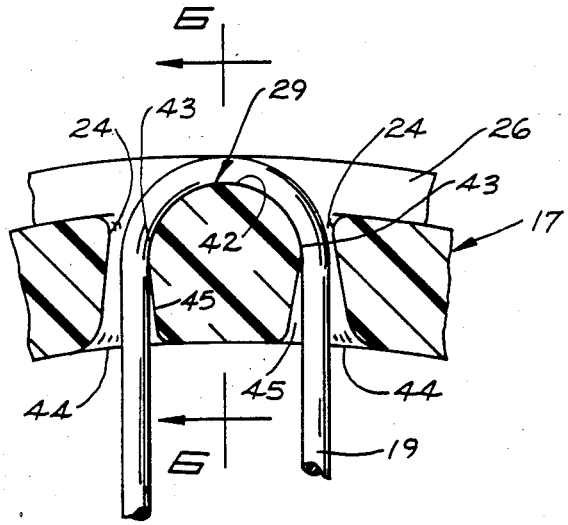
FIG 5
FIG 6
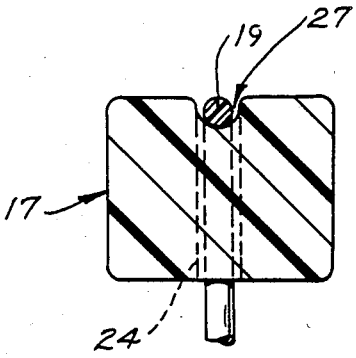

RACKET HAVING STRINGS WHICH PASS OVER ROCKABLE TENSION TRANSMITTING MEANS

FIELD OF THE INVENTION

The present invention relates to transmission of tension among the various strings of a strung sports racket upon impact with a ball or other playing object.

BACKGROUND

Most conventional sports rackets have strings which are effectively anchored as they pass across the head or face opening to the next string hole. String elasticity, static string tension, frame stiffness, strung area geometry, and balance are all factors known to affect power, control, comfort and equipment performance. Many shapes, sizes, material, string tension, weights, even grips have been tried to improve the various games.

For example, U.S. Pat. No. 3,999,756 to Head suggests enlargement of the strung area for tennis rackets to enhance physical principles such as location of the center of percussion and magnitude of the polar moment of inertia. The Head patent does not suggest change of the intrinsic physics of the ball/string/frame collision. The racket head is shown with each string chord being a different length than its neighbor. Each string is effectively anchored at opposite ends as it bends over a resilient pad on the frame and extends to the next adjacent hole. The anchored string relationship will result in high dynamic tension along the individual string cords during impact with resulting problems of string and racket breakage, sensitivity to weather, and wear. For a given racket size and shape, the player is left with a choice of how much tension to use on which brand of string, depending upon the player's style.

Placement of elastomers or springs between the strings and the frame have the same basic affect as a reduced static tension applied to the strings. The essential nature of the dynamic response is not changed.

U.S. Pat. No. 1,559,986 to Quick, U.S. Pat. No. 4,203,597 to Reedhead et al, and U.S. Pat. No. 4,462,592 to Legger et al, all exemplify spring mounting devices for tennis racket strings. They make use of various pulley or guide arrangements mounting the string cords to various forms of springs to which tension along the strings is transmitted. The springs function as reaction members with responses varying with the spring resistance to compression or extension. These patents are also illustrative of slides or sheave arrangements guiding the string courses across the racket face. While sheaves have some effect on transmission of tension from one string chord to the next, the effect is diminished significantly by the spring action.

U.S. Pat. No. 4,441,712 to Horst Guthke illustrates a tennis racket string mount. Strings are connected to the racket frame through a number of linking elements that permit displacement of the string connection points relative to the racket head frame. A complex linkage and pin arrangement is used to eliminate asymmetrical deflection of the strings in the area adjacent the head frame. The linkages are used to essentially change the anchor point of the various strings in relation to the racket head frame. The result claimed is establishment of the advantages of a large racket head in a conventional size head frame. However, the string connections extend into the string opening of the racket or otherwise effectively shorten the string dimensions extending across the racket face. Reduced string length has an effect on useful or "dynamic" string tension. Furthermore, the various pivot arrangements lose efficiency through friction at the several pivot points. Pulleys or sheaves within the racket face interconnect a single strand of string arranged through the various pulleys to form the strung racket face. The pulleys extend into the string opening and therefore effectively shorten the overall string length. They therefore decrease the opening size. Furthermore, the pulley and link arrangements add significantly to the head weight of the racket.

While the above have attained limited success, there remains a need for optimizing power and control features of a strung racket while minimizing the complexity of mechanisms for achieving such results. It is also desirable to incorporate simple, yet effective, features in a strung racket that will produce a higher coefficient of restitution (increased power for the same exertion), lower stress in the racket frame during the hit (lower magnitude vibrations), lower peak tension in the strings during the hit, balance restoring forces by providing even dynamic string tension seen by the hit object (approaching that of a uniform membrane), reducing edge effects on "off-center" hits, and producing a longer dwell time for better control and larger string deflection for additional power.

BRIEF DESCRIPTION OF THE DRAWINGS

Preferred forms of the present invention are shown in the accompanying drawings in which:

FIG. 4 is a pictorial view of a rocker device with a portion thereof broken away;

FIG. 5 is a fragmented view of a racket head frame section illustrating a second preferred form of a tension transmitting means of the present invention; and FIG. 6 is a sectional view taken substantially along line 6—6 in FIG. 5.

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

The present invention can be incorporated in any size or geometry sports racket made from any common material. For purposes of this application, an exemplary configuration is that of a mid-sized tennis racket, made from graphite fiber impregnated resin.

Figure 1:
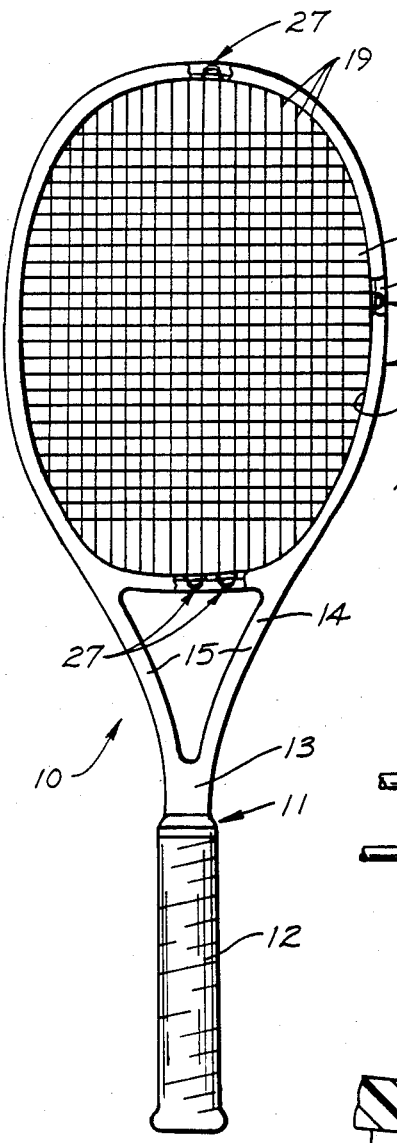
FIG. 1 is a view of a tennis racket with portions broken away to illustrate features of the present invention.

The exemplary racket is shown at 10 in FIG. 1 of the drawings. The racket 10 includes an elongated handle 11 extending from a handgrip 12 along a shaft 13 to a throat 14. The throat 14 is secured or integral with a head frame 17.

The head frame 17 is planar with the handle 11 and defines a string opening 18. A string 19 may be threaded through the head frame 17 in a cross-cross fashion of individual string chords 20. This "woven" pattern defines a planar racket face for impact with a ball or other playing object. It is preferable that the string incorporated for use with the present invention be a single strand of gut or, perhaps more preferably conventional synthetic string material. The string can be tied at opposed ends to the head frame in any conventional manner.

The head frame includes an outer surface 21 that is oriented perpendicularly to the planar racket opening. An inner surface 22 of the frame 17 defines the opening configuration. String is threaded through the head frame between surfaces 21 and 22 through string holes 24.

Conventional string holes are formed through the racket head frame in substantially radial orientations. The string, however, is oriented in chord lengths that are longitudinal (with respect to the handle) and transverse. The strings therefore are tightened against conventionally formed hole peripheries at vertices of angles formed between the radial holes and the transverse or longitudinal strings. This produces a binding or anchoring effect on the string chords.

The present string holes 24, however, are arranged to be coaxial with the strings passing through them. The present string holes are arranged in two groups. A first, longitudinal group of string holes 24 are formed through the racket head frame along parallel longitudinal axes and spaced across the head frame to receive the string portion forming the longitudinal chords. A second group of string holes are formed up the sides of the head frame between surfaces 21 and 22. The second group of holes are also parallel to one another and spaced along the head length in transverse orientation to the longitudinal string chords.

The string holes 24 are preferably of sufficient size to loosely receive the string chords. The chord segments can thus be centered within the holes without touching or rubbing against the head frame material between the outer and inner surfaces 21 and 22. The string chords 20 are therefore loosely received rather than anchored in the holes 24.

The head frame 17 may be provided with an annular channel 25 extending about its outer periphery. The base of channel 25 then becomes the outer head frame surface 21 for purposes of this description. The surface 21 is thus situated between channel walls 26 as substantially shown in FIG. 2.

Figure 2:
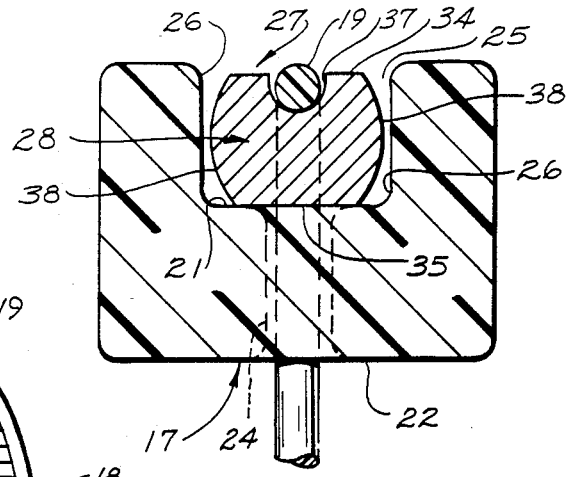
FIG. 2 is an enlarged sectional view taken through a portion of the racket head frame and taken along line 2—2 in FIG. 3.
Figure 3:
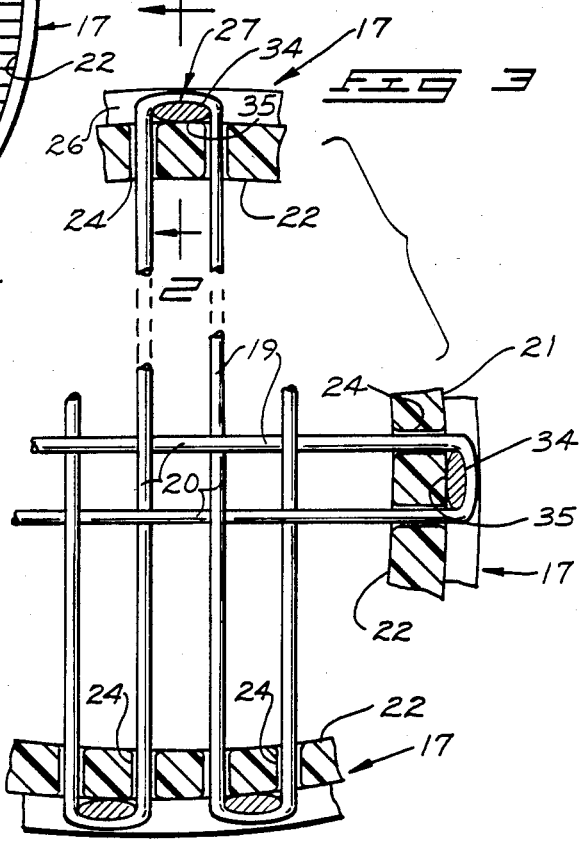
FIG. 3 is a fragmented view illustrating a portion of a string arrangement and portions of a racket including features of the present invention.

Important features of the present invention are embodied in a tension transmitting means generally shown at 27. The tension transmitting means can be provided in the form of individual rockers 28 as shown in FIGS. 2 through 4 or as integral low friction surfaces as shown in FIGS. 5 and 6. Whichever form is used, the tension transmitting means 27 is intended to transmit tension from one string chord to an adjacent chord between two adjacent string holes from the outer head frame surface 21. This is accomplished either by rocking action of the rockers 28 or by low friction, sliding contact with the integral low friction surfaces 29.

The rocker means 28 is shown in detail in FIG. 4. It includes a top surface 34 and bottom surface 35. The bottom surface is convex, preferably cylindrical. Surfaces 34 and 35 extend between smoothly curved ends 36. A groove 37 may be formed along the top surface 34 to receive and orient a string in perpendicular orientation to the preferably cylindrical configuration of the bottom surface 35. Convex side walls 38 may extend between the bottom surface 35 and top surface 34. The side walls are best identified in FIGS. 2 and 4.

The lengths of the individual rockers are such that string cords draped over the top surfaces 34 and guided over ends 36 through adjacent string holes 24 can be centered precisely within the string holes 24. Contact is made with the racket frame only by way of the rockers 28. This effectively eliminates frictional contact between the string cords and the frame head. The actual length dimension between rocker ends 36 is slightly less than the distance between centers of adjacent parallel string holes 24. The length dimensions are thus equal to the distances between adjacent string holes axes less the diameter of the string being used.

The cylindrical bottom surfaces 35 of each rocker is arranged to be received with its axis perpendicular to the racket opening or face. Contact between the cylindrical surfaces and the outer head frame surface exits along parallel tangential lines of contact perpendicular to the planar face and situated between the adjacent string cords mounted against the top surface 34.

Orientation of the cylindrical surfaces to the racket face is important in three ways.

Firstly, the cylindrical surfaces provide tangential points or "lines" of contact between the rocker and outer head frame surface 21. This very small tangential contact "line" reduces friction between the two surfaces to a negligible factor. The rockers will freely rock with extremely little frictional resistance, even with considerable tension being applied to one or both of the two adjacent string chords mounted thereto.

Secondly, the "line" tangential contacts enable the rockers to withstand the high Hertzian stresses at the frame contact interface.

Thirdly, the "lines" of tangential contact between the rockers and outer head frame surface 21 are oriented substantially parallel to the direction of impact force delivered by a ball or other playing object striking the strung face of the racket. The tangential "lines" offer insignificant resistance to rocking motion caused by tensioning of the strings but offers significant resistance to sliding action along the line of contact due to such impact forces. The rockers will freely rock against the outer head frame surface 21 on impact with a ball (due to dynamic tensioning of the string) but will resist impact forces that would tend to slide the rockers along the "lines" of contact. Should such movement occur, however, one of the convex side walls will come into contact with an adjacent channel wall 26. The convex walls are preferably semi-spherical and so will contact the channel wall only at a single tangential point. Such contact will prevent further sliding motion of the rocker across the outer head frame surface 21 with minimal affect upon the otherwise substantially friction free rocking capability of the rockers.

As indicated in FIGS. 1 and 3, a number of the individual rockers can be used. In fact, it may be preferred to place rockers between the string and outer head frame surface 21 at all points on the racket head frame where the string would otherwise be pulled tight against the outer head frame surface. Thus, the arrangement partially illustrated in FIGS. 1 and 3 could be continuous about the entire racket head frame.

It is preferable that the individual rockers be formed of a substantially rigid material such as aluminum or other lightweight, yet high strength, material. High strength plastic, such as graphite-filled polyamide may also be used as well. In fact, any material which can withstand the high Hertizan stresses at the frame contact may be used.

It is conceivable that the present rockers may be retrofitted to an existing racket frame head between adjacent string segments to provide tension transmitting capability between adjacent string chords. The rockers would function especially well in conjunction with a racket having oversized string holes or holes redrilled to loosely receive the strings coaxially as indicated above.

An example of the integral low friction surface 29 formed into the racket frame head is shown in FIGS. 5 and 6. Here, the frame head area between adjacent string holes has been formed for the purpose of transmitting tension from one string chord to the next. To this end, convex string receiving surfaces 42 are formed between adjacent string holes 24. The surfaces 42 are convex with respect to FIG. 5 but are concave in cross-section as indicated in FIG. 6 to center the string contact area in proper relation to the associated string holes 24.

The convex string receiving surfaces 42 lead tangentially into the adjacent string holes 24. For purposes of this description, the otherwise invisible points of tangency are visually indicated at 43 in FIG. 5. From these points 43 the holes 24 flare to enlarge openings 44 along the inside head frame surface 22. The "flared" string holes provide undercut areas 45, spacing the hole walls from engagement with the adjacent string chord. Thus there is minimal friction contact between the string and frame head. The only area of string contact exists along the convex string receiving surface 42. But this surface is formed to a smooth curve conducive to sliding motion of the string surface in contact therewith. This configuration, along with minimal surface-to-surface friction provides for transmission of tension from one string chord to the next.

The friction coefficient of the string and convex string receiving surfaces 42 can be influenced by low friction coatings or insets. Materials or finishes providing a friction coefficient less than 0.5 will function.

The string in the present racket is passed through the frame and over the tension transmitting means between adjacent string cords in such a way that strain energy, due to the increase in length of the string caused by collision between a ball or other playing object and the racket face, is stored in a substantial, if not the entire strung surface of the racket. As the group of strings in direct contact with the ball during the start of the collision begin to deflect and absorb energy from the impulse of the ball, the effective string length becomes the entire string length of the racket (between knots at the string ends).

This can be shown in a mathematical comparison between a conventional racket and a racket including the tension transmitting means of the present invention. A conventional racket will typically involve 8 strings (4 strings in each direction) during ball impact. These strings share storage of the strain energy and increase in length slightly as they deflect. The increase in "dynamic tension" (tension of the strings applied by the ball at impact) is calculated according to the formula:

$$Td=[(EAx)/L]+Ts$$

where

Td is the dynamic tension at a given time and where:

E is the modulus of elasticity of the string at that tension;

A is the cross sectional area of the string;

x is the increase in string length from its static state;

L is the length of the string affected; and

Ts is the static strung tension (the string tension prior to ball impact).

For a given amount of energy stored in the strings, $$\text{Energy}=[(EAx^2)/2L.]$$

The tension transfer means of the present invention allows transmission of tension from the area of impact across the remaining string cords. Thus, for example, L may include 32 strings instead of the 8 strings commonly involved with a conventional racket. The value for x would then be twice as large (x is proportional to the square root of L for a given energy). By putting 2x and 4L into the dynamic tension formula, one finds that the increase in tension during dynamic response is half as much for the present racket as for a conventional anchored string chord racket. This decrease of peak dynamic tension and increase in strain have several beneficial effects.

The string is less likely to break. The racket can be strung at a high static tension without concern that a string will break during a hit. Since peak tension is lower while the string length increases (increase in strain), the forces causing wear at the string intersections (each crossover in the weave pattern) are significantly less, so wear is decreased. There should be no wear on the strings at the racket frame with the rocker configuration since there is insignificant friction. Likewise, very little wear will be experienced along the convex string surfaces 42 in the integral low friction surface version due to the smooth, low frictional contact between the string and surfaces 42.

Since the strain increases along the string, deflection of the string surface will be greater at the location of impact. This gives a smaller restoring angle on hits near the frame, the same effect as having a very large racket. This also results in increased "dwell" time (time the ball spends in contact with the strings) for better directional control.

The tension of all string cords on the racket face remain uniform even during a hit because the tension from one string chord is distributed by the tension transmitting means 27 (rockers 28 or surfaces 42) to the remaining string chords. The ball thus sees a more balanced surface when hit off the center of the racket face where the string chords have substantially differing lengths. The resulting deeper deflection of the string surface also results in better energy transfer and higher ball velocity due to the racket's larger "sweet zone". Further, since the change in tension is less, the difference in control between hard and softer hits will be less, giving the player a wider range of available hits. In addition, more energy can be stored more quickly in the ball/string system and less energy is lost so there is less shock to the hand, wrist, arm, and elbow of the player.

There is a feeling among many players that playing with natural gut strings is better than use with synthetic strings. It is felt that this is in part due to the fact that gut has a lower modulus of elasticity at strung tensions, thus giving greater resiliency or elasticity during play. The present invention will achieve a similar effect using synthetic strings. The strings will last longer whether gut or synthetic, but the synthetics will likely play more consistently through changes in weather conditions.

It should be noted that stringing of the racket may be accomplished in substantially the usual manner. The exception is that, when using the rockers 28, individual rockers will be inserted as stringing progresses. One rocker will be placed between the string and outer head frame surface 21 at each "wrap" where the string passes through one hole and extends over the outer surface to be received through the next adjacent hole. Stringing the racket having integral low friction surfaces 29 will proceed substantially as with an ordinary conventional drilled racket, with a single long string.

A very important advantage of the present invention over other rackets employing "pulley" systems or saddle string mounts is the very basic simplicity of the present structure. By using the present invention, the head weight of the racket can be maintained at a very desirable value. Prior apparatus added to a substantially conventional head significantly increase the head weight and adversely affect racket balance and performance.

Another advantage exists in the position of the tension transmitting means such that there is no interference or intrusion into the string opening 18. This is a very important consideration since anything extending into the opening 18 will effectively diminish the opening size or decreases the effective string length. Further, the tension transmitting means require little if any maintenance and likelihood of malfunction is remote.

In compliance with the statute, the invention has been described in language more or less specific as to structural feature. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

We claim:

1. A sports racket comprising:

an elongated handle;

a head frame at an end of the handle forming a planar string opening;

wherein the head frame includes a peripheral outward facing surface substantially perpendicular to the planar string opening and an inside surface defining the opening;

a first group of substantially parallel string holes adapted to loosely receive a racket string, formed through the head frame and oriented in a first direction with respect to the elongated handle;

a second group of substantially parallel string holes formed through the head frame and oriented transversely with respect to the first direction and adapted to loosely receive a racket string; and rocker means contacting the peripheral outward facing surface and located between at least two adjacent string holes of at least one of the groups and rigid in a plane parallel to the string holes, for contacting the peripheral outward facing surface of the head frame along a single line of rocking contact perpendicular to the string holes and parallel to a plane tangential to the outward facing surface, and having an outward string receiving surface thereon adapted to receive and guide a racket string through the two adjacent string holes, forming two parallel string chords extending across the string opening, for transferring tension applied to one of the string chords to the remaining string chord by rocking along the single line of rocking contact at the peripheral outward facing surface of the head frame.

2. The sports racket as claimed by claim 1 wherein the rocker means is comprised of an elongated rigid body having;

a substantially cylindrical bottom rocking surface for rocking engagement with the outer peripheral head frame surface; and a top surface opposite the bottom rocking surface having a string receiving groove formed therein.

3. The sports racket as claimed by claim 2 wherein the peripheral head frame surface is situated at the base of a channel formed about the frame head for loosely receiving the rocker means with the bottom cylindrical rocking surface oriented substantially perpendicular to the planar string opening.

4. The sports racket as claimed by claim 3 wherein the rigid body of the rocker means includes convex side walls joining the substantially cylindrical rocking surface and outward string receiving surface.

5. A strung sports racket, comprising:

an elongated handle;

a head frame at an end of the handle forming a planar string opening along a racket face;

wherein the head frame includes an outward peripheral surface perpendicular to the planar string opening and an inward surface defining the planar string opening;

string holes defined by hole walls extending through the head frame in the plane of the string opening;

a string threaded through the string holes and extending across the string opening to form chord sections in a crisscross pattern spanning the string opening; and a plurality of tension transmitting rocker means each rigid in a plane parallel to the strings and contacting the outside surface of the frame head between adjacent string holes along a single line of rocking contact perpendicular to the strings and parallel to a plane tangential to the outward peripheral head frame surface for receiving and guiding the string chord sections through the string holes, each for rocking along its single line of contact in response to tension applied to one of the string chord sections and for transmitting the tension to the adjacent connected string chord section.

6. The sports racket as claimed by claim 5 wherein each rocker means is comprised of an elongated oval shaped body having;

a substantially elongated cylindrical rocking surface for rocking engagement with the outer peripheral head frame surface;

an elongated arcuate face opposite the rocking surface having a string receiving groove formed therein and rounded body ends joining the elongated rocking surface and elongated face.

7. The sports racket as claimed by claim 6 wherein the peripheral head frame surface is situated at the base of a channel formed about the frame head for loosely receiving the rocker means with the axis of the cylindrical rocking surface oriented substantially peripendicular to the planar string opening and spaced from the outward peripheral surface of the head frame.

8. The sports racket as claimed by claim 7 wherein the rigid body of the rocker means includes elongated convex side walls joining the substantially cylindrical rocking surface and opposite face.

* * * * *